United States Patent [19]

McMullin

[11] 4,244,407

[45] Jan. 13, 1981

[54] MECHANICAL LOG SPLITTER

[76] Inventor: Jerry L. McMullin, 705 Jensen, Idaho Falls, Id. 83401

[21] Appl. No.: 48,542

[22] Filed: Jun. 13, 1979

[51] Int. Cl.[3] ..... B27L 7/00

[52] U.S. Cl. ..... 144/193 H; 144/193 R; 254/130

[58] Field of Search ..... 254/130; 144/193 R, 144/193 C, 193 D, 193 F, 193 H

[56] References Cited

U.S. PATENT DOCUMENTS

| | | | |
|---|---|---|---|
| 128,830 | 8/1872 | Wagner | 144/193 C |
| 1,191,176 | 7/1916 | Harber | 144/193 C |

*Primary Examiner*—W. Donald Bray

*Attorney, Agent, or Firm*—Clarence A. O'Brien; Harvey B. Jacobson

[57] ABSTRACT

A base and an elongated support lever having one end thereof pivotally supported relative to the base for swinging of the support lever in an upstanding plane about an axis elevated relative to the base and for movement of the other free end of the support lever toward and away from a predetermined location on the base. An upright is carried by the base and defines a series of vertically spaced notches thereon and a downwardly facing wedge structure is carried by the free end of the support lever. The base defines support means for supporting an upstanding log section therefrom with the lower end of the log section disposed in the aforementioned predetermined location and an elongated actuating lever having anchor structure on one end is provided and the anchor structure is selectively releasably pivotally receivable in the notches and the actuating lever defines a handle on its end remote from the anchor structure. Upstanding connecting link structure is pivotally connected at one end to the support lever and at the other end to the actuating lever at a point spaced therealong from the anchor structure toward the handle end of the actuating lever.

9 Claims, 6 Drawing Figures

MECHANICAL LOG SPLITTER

BACKGROUND OF THE INVENTION

Various forms of log splitting devices have been heretofore designed. However, most log splitting devices are power driven and those which are not power driven and are adapted to be manually powered are cumbersome to use and do not provide sufficient mechanical leverage to enable hardwood logs to be readily split.

Accordingly, a need exists for a simple, mechanically operated log splitter which will provide sufficient leverage to enable ease of operation even when splitting hardwood logs.

Examples of previously known forms of log splitters including some of the general structural and operational features of the instant invention as well as other similar devices as disclosed in U.S. Pat. Nos. 720,010, 881,538 and 4,112,985.

BRIEF DESCRIPTION OF THE INVENTION

The log splitter of the instant invention is constructed in a manner whereby considerable mechanical leverage is afforded a person desiring to split a log and whereby the log splitting wedge portion of the splitter may be forced into the log to be split in successive increments of penetration with each increment of penetration affording the same mechanical leverage as the preceding increment of penetration.

The main object of this invention is to provide a log splitter which may be conveniently utilized by a single person in splitting logs.

Another object of this invention is to prepare a log splitter which will be operative to split long logs as well as short logs with the same efficiency.

Yet another object of this invention is to provide a log splitter which will afford a considerable mechanical advantage to the person using the splitter for the purpose of splitting logs.

Another object of this invention is to provide a log splitter which may be readily transported from one location to another.

Still another important object of this invention is to provide a log splitter which may be constructed from readily available components.

A final object of this invention to be specifically enumerated herein is to provide a log splitter in accordance with the preceding objects and which will conform to conventional forms of manufacture, be of simple construction and easy to use so as to provide a device that will be economically feasible, long lasting and relatively trouble free in operation.

These, together with other objects and advantages which will become subsequently apparent, reside in the details of construction and operation as more fully hereinafter described and claimed, reference being has to the accompanying drawings forming a part hereof, wherein like numerals refer to like parts throughout.

DETAILED DESCRIPTION OF THE INVENTION

Figure 1:
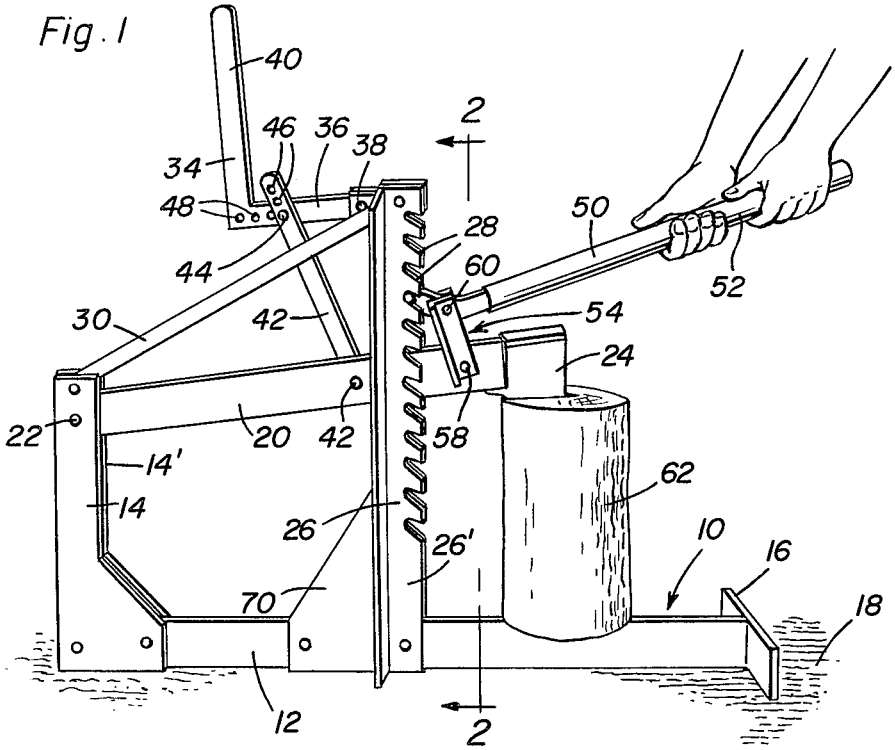
FIG. 1 is a perspective view of the log splitter in use for the purpose of splitting a log.

Referring now more specifically to the drawings, the numeral 10 generally designates the log splitter of the instant invention. The log splitter 10 includes a horizontally elongated base 12 including a support upright 14 on one end. The other end of the base 12 includes a transverse member 16 supported therefrom for steadying the base 12 upon the ground 18 upon which the base 12 rests.

The support upright 14 has one base end of an elongated lever 20 pivotally supported therefrom as at 22 and the other free end of the lever 20 includes a downwardly facing wedge member 24 supported therefrom.

The intermediate portion of the base 12 includes an upright standard 26 defining a series of vertically spaced horizontally outwardly and downwardly opening notches 28 and an inclined brace 30 extends between and is secured to the upper end of the support upright 14 and the upright standard 26.

The base 12, intermediate the upright standard 26 and the transverse member 16, includes upwardly projecting log bottom anchoring teeth 32 and an L-shaped lever 34 has the free end of its short leg 36 pivotally anchored to the upper end of the upright standard 26 as at 38. The long leg 40 of the lever 34 defines a handle and an elongated connecting link 42 has one end thereof pivotally connected to a longitudinal midportion of the lever 20 as at 42 and the other end thereof pivotally connected to the short leg 36 of the lever 34 as at 44. The pivot connection at 44 is defined by a pivot fastener removably secured through selected longitudinally spaced bores 46 in the connecting link 42 and longitudinally spaced bores 48 formed in the short leg 36 of the lever 34.

An elongated actuating lever 50 is provided and one end of the lever 50 includes a cross pin 52 which is selectively receivable and rotatable in the notches 28. The other end of the lever 50 defines a handle 52 and a connecting link structure referred to in general by the reference numeral 54 and including a pair of opposite side links 56 has one end thereof pivotally anchored to the lever 20 as at 58 and the other end thereof pivotally anchored relative to the lever 50 as at 60.

When it is desired to split a log section, the log section 62 is placed upon the base 12 with the teeth 32 biting into the lower end of the log section 62. Thereafter, the lever 50 is swung to a substantially vertical position with the pin 52 spaced outwardly of the side of the upright standard 26 through which the notches 28 open. Then, the upper end of the connecting link structure 54 is swung toward the upright standard 26 in order to engage the pin 52 in one of the notches 28. After the pin 52 has been engaged in one of the notches 28, downward pressure is applied to the handle 52 whereby the wedge member or structure 24 will be driven a short distance downwardly into the leg section 62. As soon as the lever 50 reaches a generally horizontal position, the handle end 52 thereof is swung upwardly and pulled outwardly away from the upright standard 26 toward a vertical position. This, of course, causes the pin 52 to be disengaged from the slot 28 and will lower pin 52 for engagement with a lower notches 28 on the upright standard 26. After the pin 52 has been engaged in the lower notch 28, the same process is repeated in order to further downwardly force the wedge structure 24 into the log section 62 until the latter splits.

Figure 5:
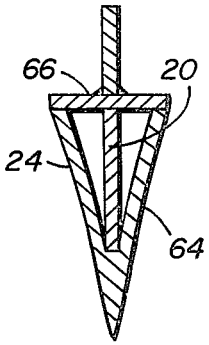
FIG. 5 is an enlarged fragmentary transverse vertical sectional view taken substantially upon the plane indicated by the section line 5—5 of FIG. 3.
Figure 2:
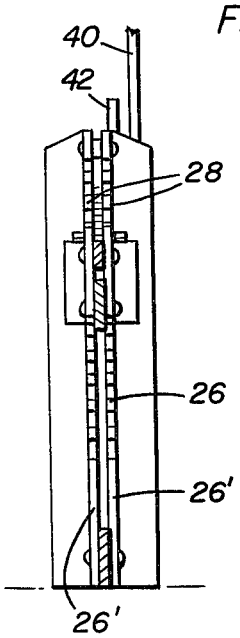
FIG. 2 is a fragmentary vertical sectional view taken substantially upon the plane indicated by the section line 2—2 of FIG. 1.

With attention invited more specifically to FIG. 5 of the drawings, it may be seen that the web structure 24 comprises a V-shaped member 64 with the associated end of the lever 20 defining a center web portion with a V-shaped member 64. A closure plate 66 is secured across the upper edges of the upper ends of the legs of the V-shaped member 64 and the upper edge of the corresponding portion of the lever 20 thus defining an abutment surface for engagement by the lever 50 when the latter is in the position thereof illustrated in FIG. 3 of the drawings.

Figure 3:
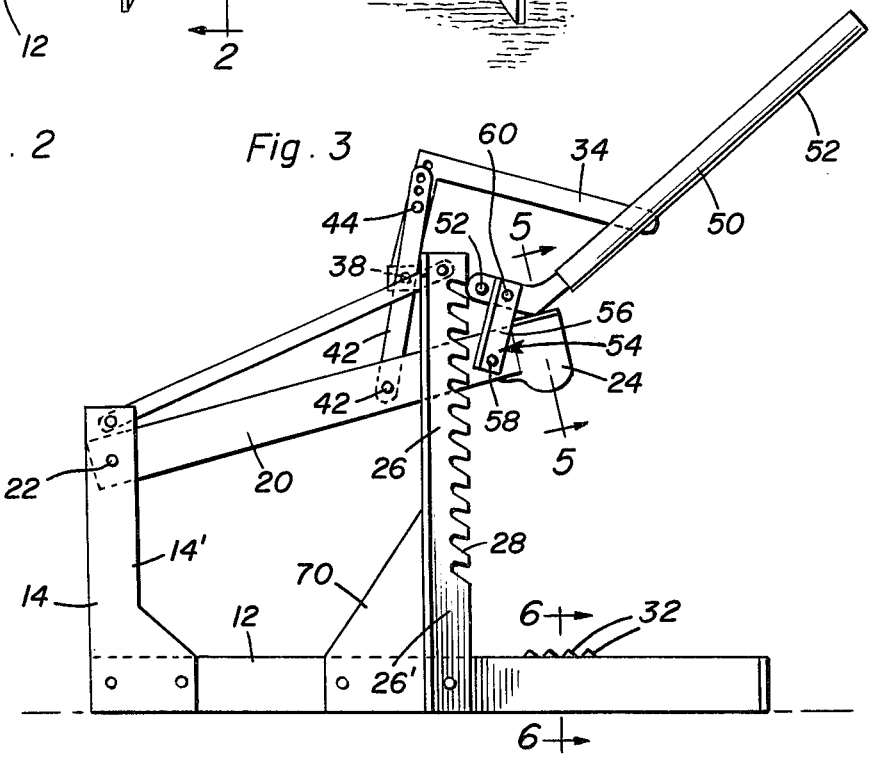
FIG. 3 is a side elevational view of the log splitter with the log splitting components thereof in a static raised elevated position preparatory to the placement of a log on the base of the log splitter for the purpose of splitting the logs.
Figure 4:
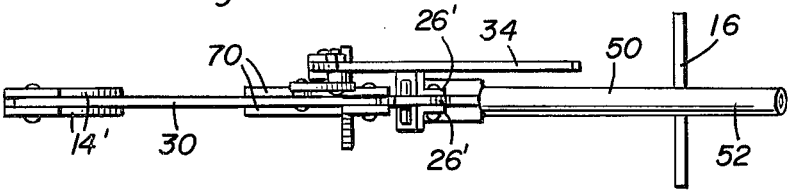
FIG. 4 is a top plan view of the assemblage illustrated in FIG. 3.
Figure 6:
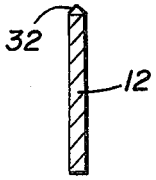
FIG. 6 is an enlarged transverse vertical sectional view taken substantially upon a plane indicated by the section line 6—6 of FIG. 3.

The lever 34 may be swung from the position thereof illustrated in FIG. 1 of the drawings to the position thereof in FIG. 3 of the drawings in order to retain the wedge member supporting end of the lever 20 in the elevated position thereof illustrated in FIG. 3. When the lever 34 is swung to the position illustrated in FIG. 3, the pivot point 44 passes through a center plane containing the pivot connections 38 and 42 and thereby moves into an over-center position with the lever 20 supported in the raised inoperative position illustrated in FIG. 3, the vertical midportion of the connecting link 42 abutting the upper end of the upright standard 26 in order to define a limit position of movement of the link 42 to its over-center position.

It will be noted that the upright standard 26 comprises a pair of opposite side notched standards 26', that the support upright 14 comprises a pair of opposite side uprights 14' and that the lever 20 is disposed between the uprights 14' and the standards 26'. Further, it will also be noted that the upright standard 26 is braced relative to the base 12 by means of buttress plates 70.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A log splitter including a base, an elongated support lever, means pivotally supporting one end of said lever relative to said base for swinging of the support lever is an upstanding plane about a first axis elevated relative to said base and for movement of the other end of said support lever toward and away from a predetermined location on said base while the other end of said lever is elevated above said base, an upright carried by said base and defining a series of vertically spaced notches thereon, a downwardly facing wedge structure carried by said other end of said support lever opposing said predetermined location, said base defining support means for supporting an upstanding log section therefrom with the lower end of said log section disposed in said predetermined location, an elongated actuating lever having anchor structure on one end thereof selectively releasably pivotally receivable in said notches and defining a handle on its other end, and upstanding connecting link structure pivotally connected at one end to said other end of said support lever and at the other end to said one end of said actuating lever at a point thereon spaced from said anchor structure.

2. The combination of claim 1 wherein said notches open downwardly and outwardly away from the side of said upright remote from said axis.

3. The combination of claim 1 wherein said base comprises an elongated member, said predetermined location being disposed on one end of said base, said upright being supported from the central portion of said base and an upstanding support carried by the other end of said base, said one end of said support lever being pivotally anchored relative to the upper end of said support.

4. The combination of claim 3 including a brace extending and secured between the upper ends of said upstanding support and upright.

5. The combination of claim 3 wherein said predetermined location includes a plurality of horizontally spaced upwardly facing teeth supported from said base for penetratingly engaging the lower end of the log section.

6. The combination of claim 1 including means operatively connected between said support lever and upright operated to releasably retain said support lever with the other end thereof in a predetermined elevated position.

7. The combination of claim 6 wherein said base comprises an elongated member, said predetermined location being disposed on one end of said base, said upright being supported from the central portion of said base and an upstanding support carried by the other end of said base, said one end of said support lever being pivotally anchored relative to the upper end of said support.

8. The combination of claim 7 including a brace extending and secured between the upper ends of said upstanding support and upright.

9. The combination of claim 8 wherein said predetermined location includes a plurality of horizontally spaced upwardly facing teeth supported from said base for penetratingly engaging the lower end of the log section.

* * * * *